US006045002A

United States Patent [19]

Wierschke

[11] Patent Number: 6,045,002

[45] Date of Patent: Apr. 4, 2000

[54] STACK COMPRISING V-Z FOLDED SHEETS

[75] Inventor: Larry D. Wierschke, Green Bay, Wis.

[73] Assignees: Paper Converting Machine Company, Green Bay, Wis.; Procter & Gamble Corporation, Cincinnati, Ohio

[21] Appl. No.: 09/113,226

[22] Filed: Jul. 10, 1998

[51] Int. Cl.[7] ..... A47K 10/24

[52] U.S. Cl. ..... 221/48; 206/494

[58] Field of Search ..... 221/48, 47, 50, 221/33; 206/554, 812, 494

[56] References Cited

U.S. PATENT DOCUMENTS

| | | | |
|---|---|---|---|
| 3,207,360 | 9/1965 | Scott | 221/48 |
| 3,401,928 | 9/1968 | Frick | 270/40 |
| 3,462,043 | 8/1969 | Frick | 221/48 |
| 4,131,271 | 12/1978 | Slawny | 270/40 |
| 4,138,034 | 2/1979 | McCarthy | 221/48 |
| 4,824,426 | 4/1989 | DeFresne | 493/346 |
| 5,219,092 | 6/1993 | Morand | 221/53 |
| 5,497,903 | 3/1996 | Yoneyama | 221/48 |
| 5,868,276 | 2/1999 | Loppnow et al. | 221/48 |

*Primary Examiner*—Kenneth W. Noland

[57] ABSTRACT

A stack of folded sheets includes right and left Z folded sheets and right and left V folded sheets which are arranged and interfolded so that the stack is balanced and has uniform bulk across its width. Withdrawal of the top sheet of the stack lifts the next sheet into position for withdrawal.

12 Claims, 5 Drawing Sheets

STACK COMPRISING V-Z FOLDED SHEETS

BACKGROUND

This invention relates to folded sheets of paper tissue or similar material. More particularly, the invention relates to a balanced stack of interfolded sheets wherein removal of the top sheet moves the next sheet into position for removal.

Paper products such as sheets of tissues and towels are conventionally folded and superposed to form a stack which may be stored in a container or dispenser. It is desirable to interfold or interleave the sheets of the stack so that removing the top sheet from the container causes the next sheet to "pop-up" or move into position for removal. It is also desirable that the stack be balanced, i.e., have uniform bulk across its width. Any vertical cross section through the stack should have substantially the same number of layers of sheet material.

The folded sheets can be either wet or dry. Wet sheets are pre-moistened and present additional packaging considerations. The moisture creates additional friction as the interfolded sheets are withdrawn, and the portion of the sheet which extends out of the container is subject to drying. The exposed portion should therefore be relatively short.

U.S. Pat. No. 4,138,034 describes a package of pre-moistened interleaved sheets. The sheets may have alternating V folds, or alternating Z folds.

U.S. Pat. No. 3,401,928 describes a stack of interleaved sheets in which each sheet includes two quarter folds on the top and a half-width fold on the bottom (FIG. 9). Adjacent sheets are folded in opposite directions so that the stack is balanced.

U.S. Pat. No. 5,497,903 describes a stack which is essentially an inversion of the stack of the '928 patent.

SUMMARY OF THE INVENTION

The invention combines two simple types of known folds, a V fold and a Z fold, in a unique manner to provide a balanced stack which dispenses in the same way regardless of which end of the stack is up. Right and left V folded sheets are interleaved with right and left Z folded sheets. The center panel of each Z folded sheet has the same width as the top and bottom panels of the V folded sheets, and the widths of the top and bottom panels of the Z folded sheets add up to substantially the same width as the center panel. The folds are provided by four conventional V and Z folding plates.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
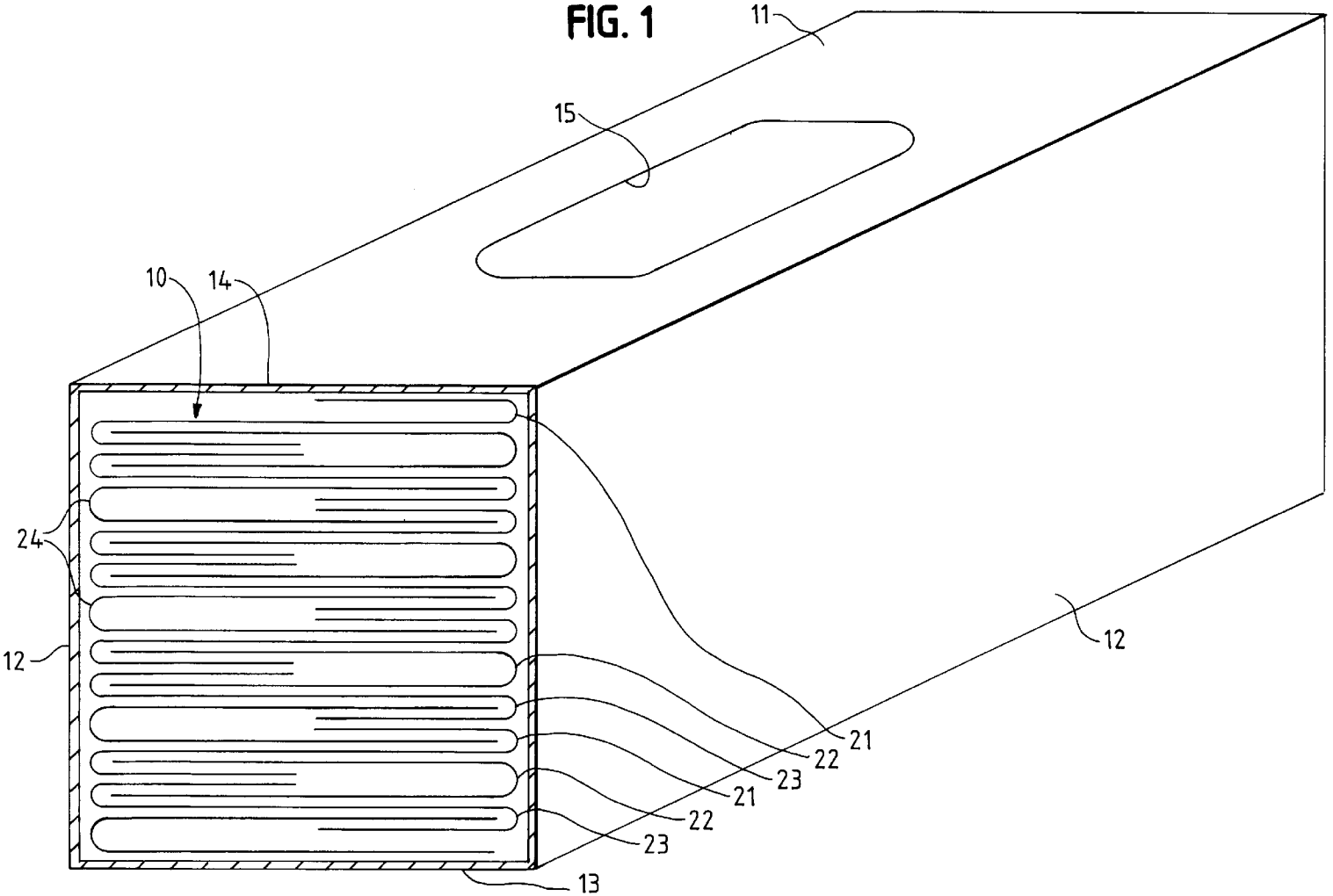
FIG. 1 is a perspective sectional view of a container with a stack formed in accordance with the invention.

Referring to FIG. 1, a stack 10 of interleaved sheets is contained with a container or dispenser 11. The container is conventional and includes two side walls 12, a bottom wall 13, a top wall 14, and a pair of end walls (not shown). An opening 15 is provided in the top wall for withdrawing the sheets. Before use, the opening 15 is closed with a tear-out tab, plastic film, or the like. If the stack comprises pre-moistened sheets, the opening can be in the form of a narrow slit to reduce the exposure of the stack.

The stack is formed from four groups of folded sheets—right Z folded sheets 21, left V folded sheets 22, left Z folded sheets 23, and right V folded sheets 24.

Each right Z folded sheet includes a center panel 21*a* (FIG. 3), right and left folded edges 21*b* and 21*c*, and top and bottom end panels 21*d* and 21*e*.

Each left folded V sheet includes top and bottom panels 22*a* and 22*b* which are joined along a right folded edge 22*c*.

Each left folded Z sheet includes a center panel 23*a*, right and left folded edges 23*b* and 23*c*, and top and bottom end panels 23*d* and 23*e*.

Each right folded V sheet includes top and bottom panels 24*a* and 24*b* which are joined along a left folded edge 24*c*.

Figure 3:
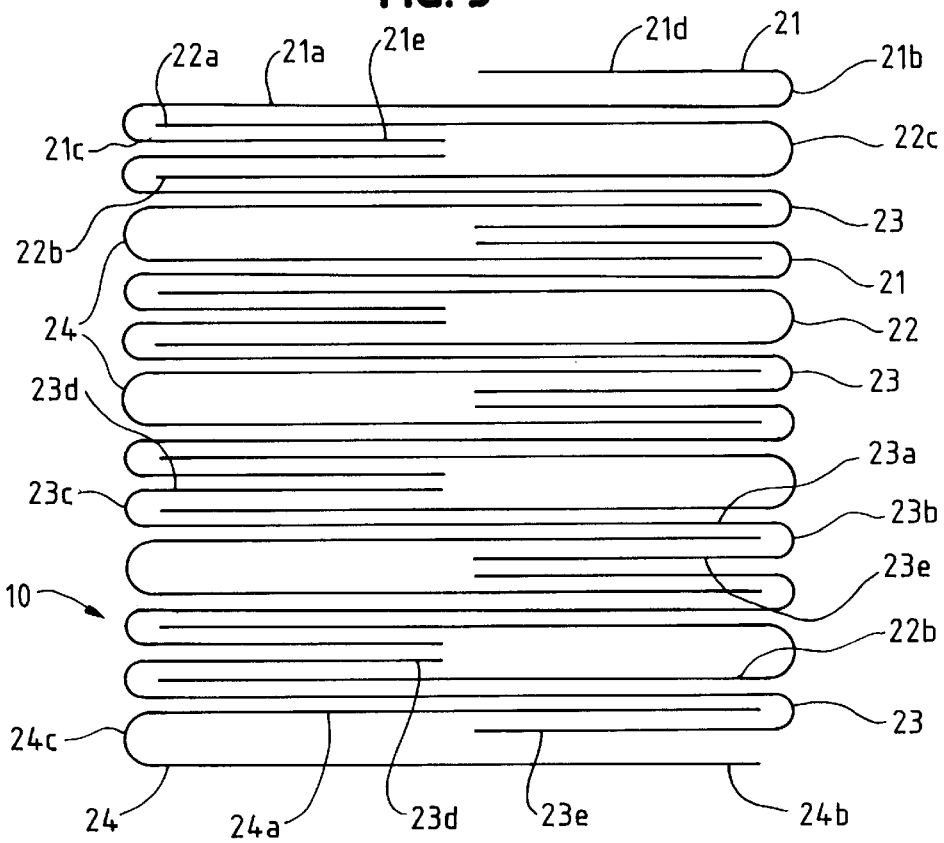
FIG. 3 is an end view of the stack of FIGS. 1 and 2.

In the stack 10 illustrated in FIGS. 1 and 3, the center panels 21*a* and 23*a* of the Z folded sheets have substantially the same width as the top and bottom panels 22*a*, 22*b*, 24*a*, and 24*b* of the V folded sheets. Those panels define the width of the stack which is just slightly less than the inside width dimension of the container 11.

The top panels 21*d* and 23*d* and the bottom panels 21*e* and 23*e* of the Z folded sheets extend for about one-half of the width of the center panels 21*a* and 23*a*. The edges of the top and bottom panels are positioned at about the middle of the stack but are spaced apart slightly so that they do not overlap.

The stack 10 is therefore evenly balanced. Any longitudinal vertical cross section through either the right or left half of the stack will have the same number of sheet layers. The stack will therefore remain upright and does not have a tendency to lean to one side or the other.

The stack 10 is also symmetrical. There is equal overlap for all sheets, and the stack will dispense in the same way regardless of which end of the stack is up.

Figure 2:
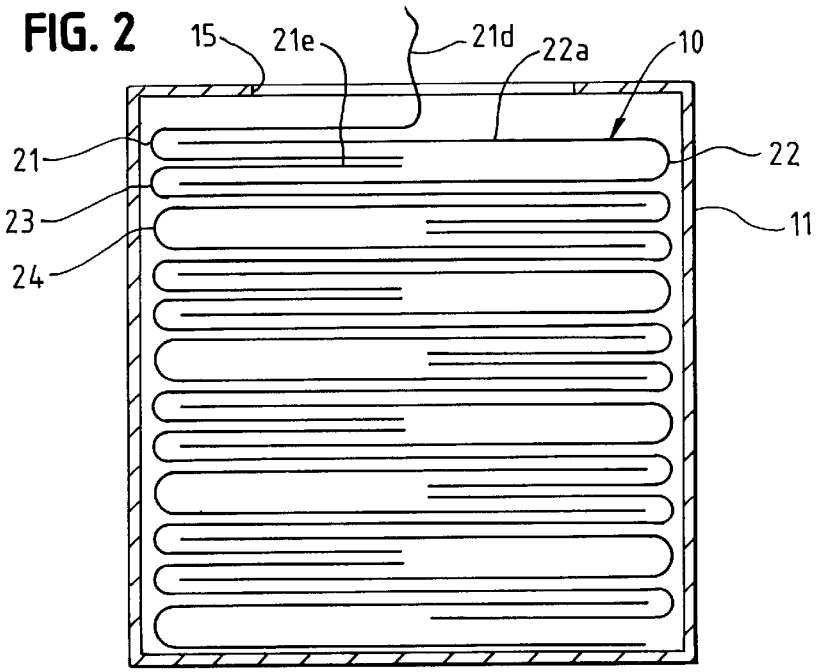
FIG. 2 is a sectional view of the container and the stack with top sheet in a dispensing position in which it extends through the opening in the container.

FIG. 2 illustrates the stack 10 with the top panel 21*d* of the topmost sheet pulled through the opening 15 of the container. The topmost sheet can be withdrawn from the container by pulling the top panel 21*d* upwardly.

As the top sheet is withdrawn from the container, the bottom panel 21*e* pulls the top panel 22*a* of the second sheet through the opening 15 so that the second sheet 22 will be in position to be dispensed.

When the second sheet 22 is withdrawn from the container, the bottom panel 22*b* pulls the top panel 23*d* of the third sheet through the opening so that the third sheet is in position to be dispensed. Withdrawing each sheet therefore moves the next sheet into position to be withdrawn. Only about one-quarter of the entire width of a sheet will be withdrawn from the carton by the preceding sheet. If the sheet is moistened, only a minor portion of the sheet is exposed outside of the container.

Figure 4:
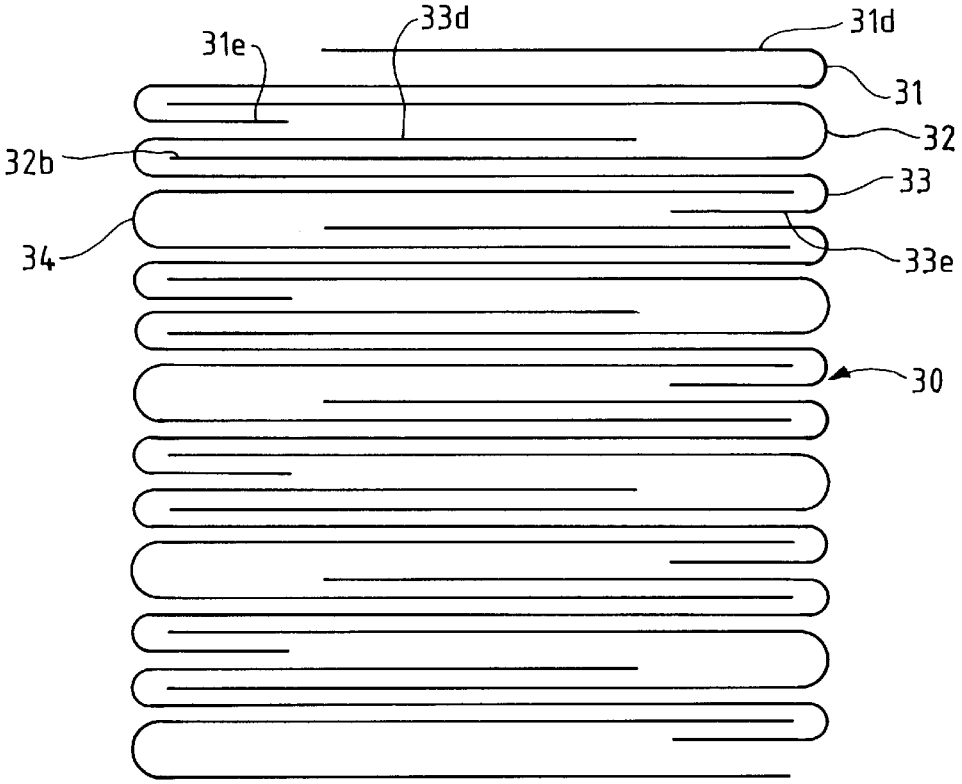
FIG. 4 is an end view of a modified stack.

Referring to FIG. 4, a stack 30 similarly includes right Z folded sheets 31, left V folded sheets 32, left Z folded sheets 33, and right V folded sheets 34. However, the top panels 31*d* and 33*d* of the Z folded sheets are longer than the bottom panels 31*e* and 33*e*.

The edges of the top and bottom panels are substantially aligned, and the width of the top panels plus the width of the bottom panels is substantial equal to, and preferably slightly less than, the width of the center panels 31*a* and 33*a*. The stack 30 is therefore also evenly balanced. Any longitudinal vertical cross section through the stack will have the same number of sheet layers.

One advantage of the stack 30 over the stack 10 is that the bottom panel of the V folded sheets have more contact with the top panel of the Z folded sheets. For example, when the V folded sheet 32 is pulled out of the container, the bottom panel 32*b* contacts the top panel 33*d* of the next lower Z sheet over more than one-half of the width of the panels. It is therefore less likely that the bottom panel 32*b* will slip out of contact with the panel 33*d* before the panel 33*d* is pulled through the opening 15.

The bottom panel of each of the Z folded sheets underlaps the top panel of a V folded sheet to a lesser extent in stack 30 than in stack 10. However, because the bottom panel of the Z sheet is turned under the top panel of the V sheet, the top panel is retained within the bottom fold of the Z sheet sufficiently to ensure that the V sheet will be pulled through the opening.

In both stack 10 and stack 30, as the topmost sheet is pulled out of the container, the portion of the top panel of the next sheet which is pulled through the opening 15 is the portion which extends beyond the opening 15. However, the amount of the panel which is pulled through can be affected by the degree to which one sheet is adhered to the next sheet due to capillary attraction between the two moistened sheets. The degree of adhesion is influenced by the characteristics of the sheet material and the moistening fluid.

FIGS. 5–8 illustrate folding plates 41, 42, 43, and 44 for folding the right Z folded sheets 21, the left V folded sheets 22, the left Z folded sheets 23, and the right V folded sheets 24. Such folding plates are conventional and well known in the industry. For example, U.S. Pat. Nos. 4,131,271 and 3,401,928 describe folding plates. Accordingly, the details of the folding plates need not be described herein.

Figure 5:
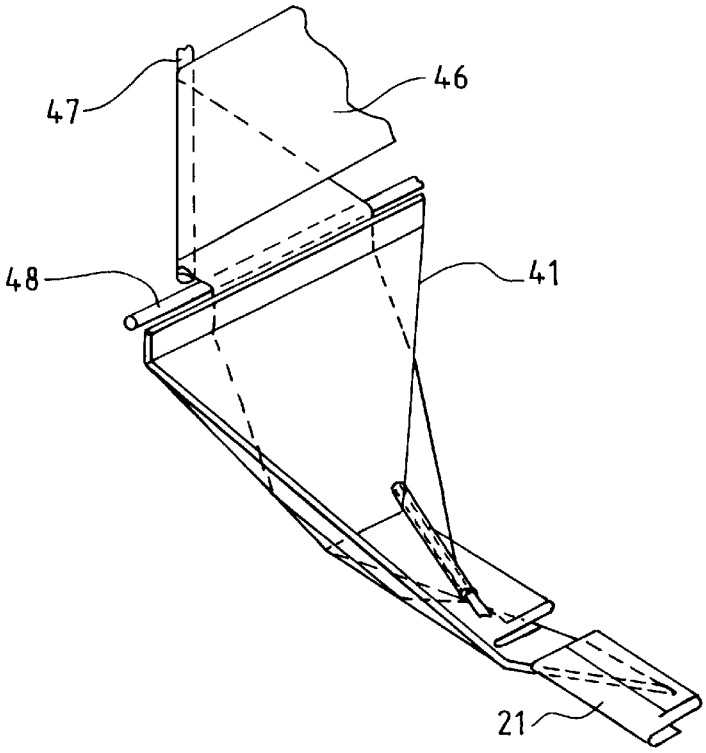
FIG. 5 illustrates the folding plate for folding the right Z folded sheets.

In FIG. 5, a web 46 of tissue or towel material is advanced over turning bars 47 and 48 and folding plate 41 and is folded into a right Z fold sheet 21.

Figure 6:
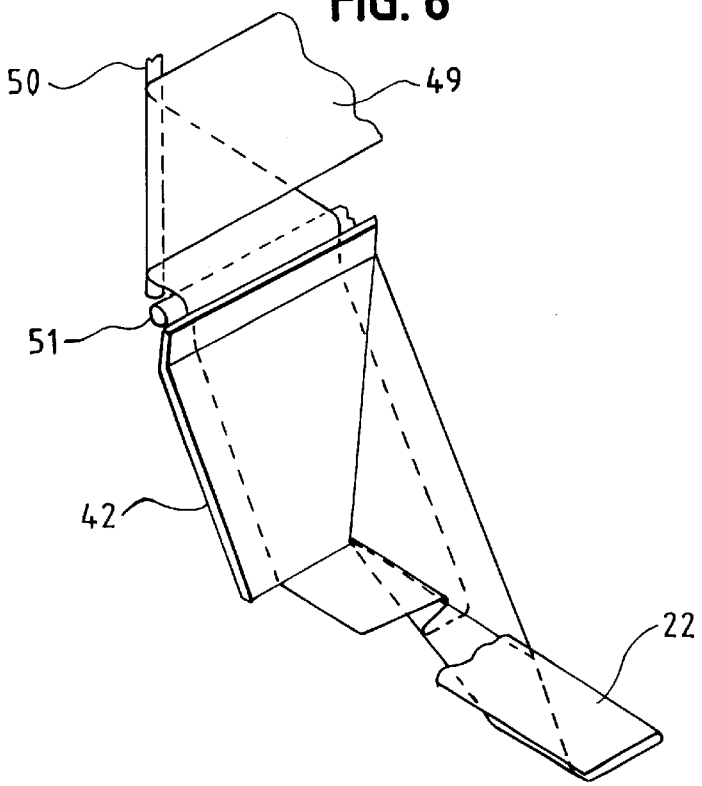
FIG. 6 illustrates the folding plate for folding the left V folded sheets.

In FIG. 6, a web 49 passes over turning bars 50 and 51 and folding plate 42 and is folded into a left V folded sheet 22.

Figure 7:
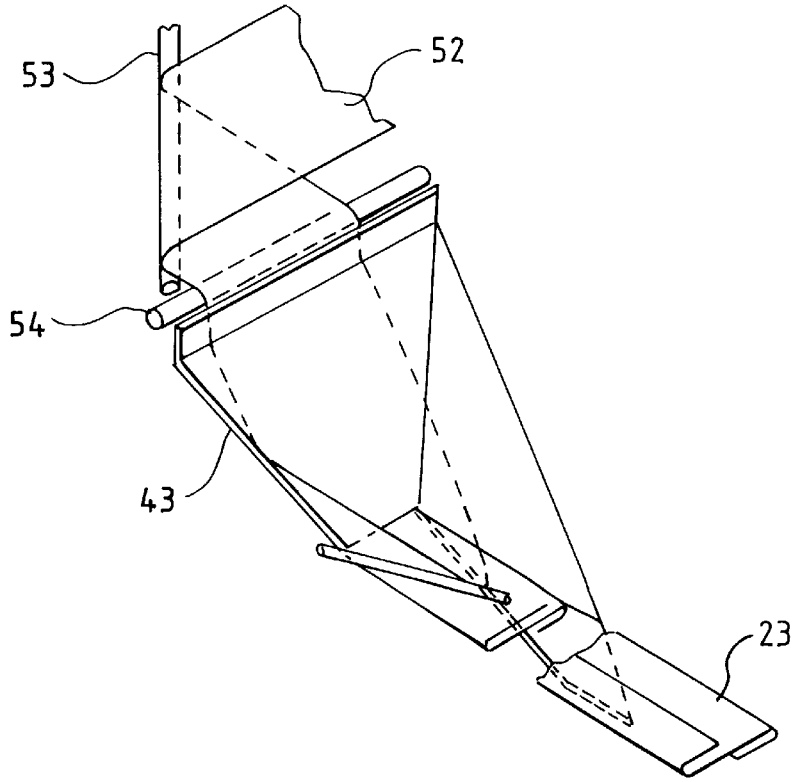
FIG. 7 illustrates the folding plate for folding the left Z folded sheets.

In FIG. 7, a web 52 passes over turning bars 53 and 54 and folding plate 43 and is folded into a left Z folded sheet 23.

Figure 8:
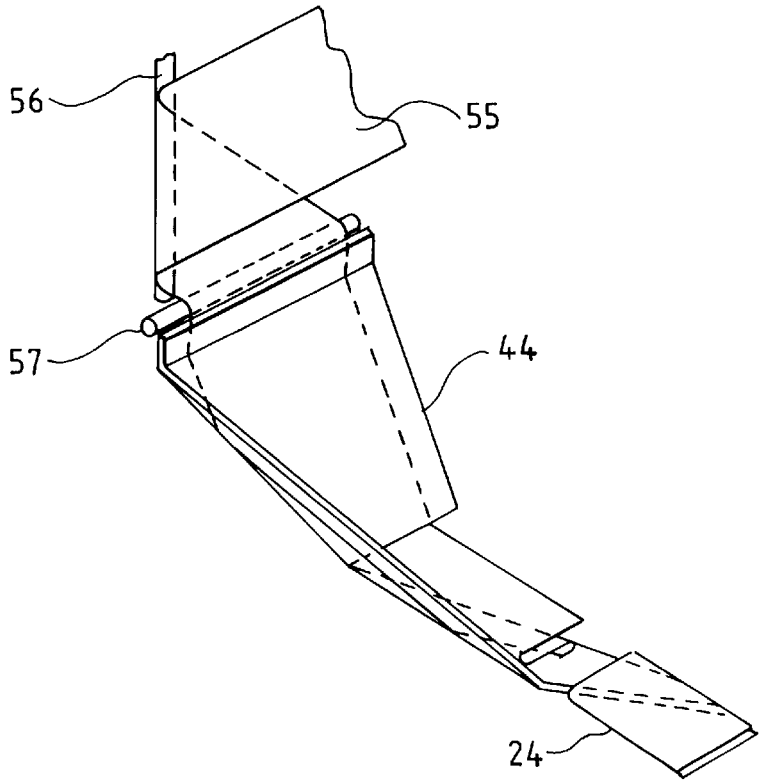
FIG. 8 illustrates the folding plate for folding the right V folded sheets.

In FIG. 8, a web 55 passes over turning bars 56 and 57 and folding plate 44 and is folded into a right V folded sheet 24.

A separate web is used for each sheet of the stack, and the stack is formed from the bottom up. Referring to FIG. 3, the bottom right folded V sheet 24 is formed first. As the left folded Z sheet 23 is being formed, the top panel 24*a* of the V sheet moves through a slot in the folding plate for sheet 23 so that the panel 24*a* is interleaved with the bottom panel 23*e*.

As the left folded V sheet 22 is being formed, the top panel 23*d* of the Z sheet moves through a slot in the folding plate for sheet 22 so that the top panel 23*d* is interleaved with the bottom panel 22*b*.

The folding and interleaving process continues until the entire stack is formed. The stacked webs are then severed transversely to form discrete stacks which are inserted into containers 11.

The length of the panel of the Z folded sheets can be readily adjusted simply by moving the location of the turning bar ahead of each Z folding plate. Thus, the fold can be adjusted to suit the nature of dispensing caused by characteristics of sheet material and moistening fluid. Adjusting the length of the top panel of the Z folded sheets also changes the length of the bottom panel. The uniform bulk of the stack is therefore maintained.

Figure 9:
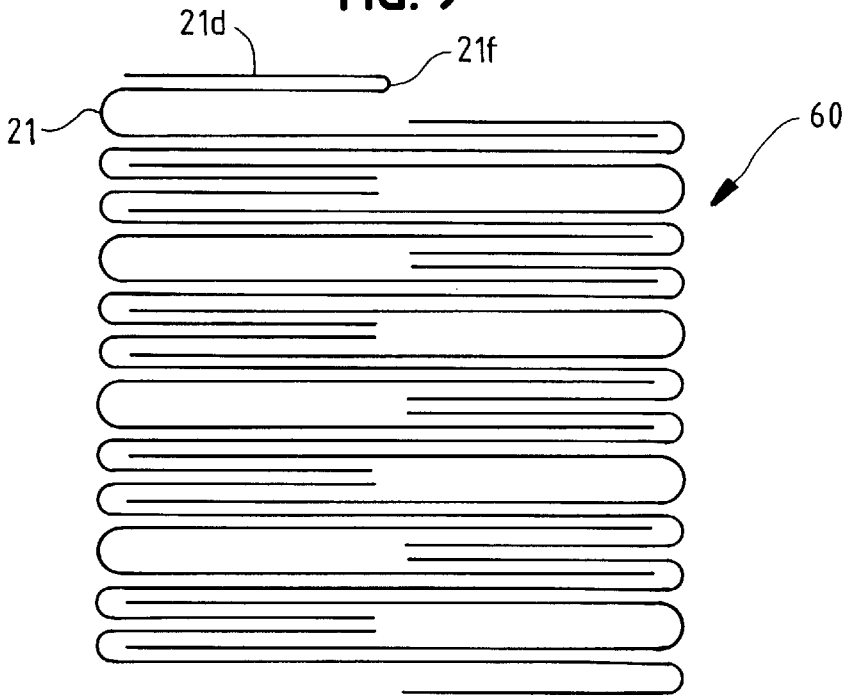
FIG. 9 is an end view of another embodiment of a stack in which the top sheet is a V folded sheet which is folded to provide a starter panel.

Referring to FIG. 9, a stack 60 is substantially the same as stack 10 except that the top panel 21*d* of the topmost sheet 21 is folded back on itself to provide a starter panel 21*f* (see, for example, U.S. Pat. No. 4,824,426). When it is desired to begin using the stack 60, the double thickness of the reversely folded starter panel is easily grasped and pulled through the opening 15 of the container.

The V-Z folded stack described herein includes the following advantages:

1. Conventional, low-cost folding plates are used to produce known folds.
2. Substantial flexibility can be obtained by adjusting the plate combinations and/or web centering on the plates. Such flexibility is beneficial in running the wide variety of nonwoven materials which are available to the market.
3. A wide range of materials can be run, including air laid and spunlace nonwovens.
4. In the symmetrical stack of FIG. 3, there is a maximum of one-half panel overlap for easier release of wet or pre-moistened sheets. There is equal overlap of all sheets. The stack has no defined top or bottom. The stack will dispense in the same way whether the stack is upright or inverted.
5. In the assymmetrical stack of FIG. 4, there is greater contact between the bottom panel of each V folded sheet and the top panel of the next Z folded sheet. More reliable dispensing can therefore be obtained.
6. The stack is balanced.

While in the foregoing specification a detailed description of specific embodiments of the invention was set forth for the purpose of illustration, it will be understood that many of the details herein given can be varied considerably by those skilled in the art without departing from the spirit and scope of the invention.

I claim:

1. A stack of folded sheets comprising:

a) a first group of generally Z folded sheets, each of the sheets of the first group including a center panel having right and left edges which define the width of the center panel, a top end panel extending from said right edge toward said left edge for a portion of the width of the center panel, and a bottom end panel extending from said left edge toward said right edge for a portion of the width of the center panel, b) a second group of generally V folded sheets, each of the sheets of the second group including a right folded edge and top and bottom panels which extend from said right folded edge, c) a third group of sheets of generally Z folded sheets, each of the sheets of the third group including a center panel having right and left edges which define the width of the panel, a top end panel extending from said left edge toward said right edge for a portion of the width of said center panel, and a bottom end panel extending from said right edge toward said left edge for a portion of the width of said center panel, and d) a fourth group of sheets of generally V folded sheets, each of the sheets of the fourth group including a left folded edge and top and bottom panels which extend from said left folded edge, said sheets being arranged so that:

e) the bottom panel of each sheet of the first group is interleaved with the top panel of a sheet of the second group, f) the bottom panel of each sheet of the second group is interleaved with the top panel of a sheet of the third group, g) the bottom panel of each sheet of the third group is interleaved with the top panel of a sheet of the fourth group, and h) the bottom panel of each sheet of the fourth group is interleaved with the top panel of a sheet of the first group.

2. The stack of claim 1 in which the width of the center panel of each sheet of the first and third groups is substantially the same as the width of the top and bottom panels of each sheet of the second and fourth groups.

3. The stack of claim 2 in which the width of the top panel plus the width of the bottom panel of each sheet of the first and third groups is slightly less than the width of the center panel of the sheet.

4. The stack of claim 2 in which the width of the top and bottom panels of each sheet of the first and third groups is slightly less than one-half of the width of the center panel of the sheet.

5. The stack of claim 1 in which the width of the top panel plus the width of the bottom panel of each sheet of the first and third groups is slightly less than the width of the center panel of the sheet.

6. The stack of claim 1 in which the width of the top and bottom panels of each sheet of the first and third groups is slightly less than one-half of the width of the center panel of the sheet.

7. A method of forming a stack of folded sheets comprising:

folding a first sheet into substantially a Z shape having a center panel with right and left edges, a top end panel extending from the right edge, and a bottom end panel extending from the left edge, folding a second sheet into substantially a V shape having a right folded edge and top and bottom panels which extend from the right folded edge, folding a third sheet into substantially a Z shape having a center panel with right and left edges, a top end panel extending from the left edge, and a bottom end panel extending from the right edge, folding a fourth sheet into substantially a V shape having a left folded edge and top and bottom panels which extend from the left folded edge, and superposing the first, second, third, and fourth sheets so that the bottom panel of the first sheet is interleaved with the top panel of the second sheet, the bottom panel of the second sheet is interleaved with the top panel of the third sheet, and the bottom panel of the third sheet is interleaved with the top panel of the fourth sheet.

8. The method of claim 7 in which the sheets are folded so that the width of the center panels of the first and third sheets and the width of the top and bottom panels of the second and fourth sheets are substantially the same.

9. The method of claim 8 in which each of the first and third sheets is folded so that the width of the top panel plus the width of the bottom panel is slightly less than the width of the center panel.

10. The method of claim 8 in which each of the first and third sheets is folded so that the width of the top and bottom panels is slightly less than one-half of the width of the center panel.

11. The method of claim 7 in which each of the first and third sheets is folded so that the width of the top panel plus the width of the bottom panel is slightly less than the width of the center panel.

12. The method of claim 7 in which each of the first and third sheets is folded so that the width of the top and bottom panels is slightly less than one-half of the width of the center panel.

* * * * *